US010993599B2

(12) United States Patent
Fisher et al.

(10) Patent No.: US 10,993,599 B2
(45) Date of Patent: May 4, 2021

(54) DISH OVERFLOW PROTECTION SYSTEMS FOR DISH MACHINES AND METHODS OF MAKING AND USING SAME

(71) Applicant: TCD PARTS, INC., Edgerton, MO (US)

(72) Inventors: Mark B. Fisher, Edgerton, MO (US); Joel Gross, Gilbert, AZ (US)

(73) Assignee: TCD PARTS, INC., Edgerton, MO (US)

( * ) Notice: Subject to any disclaimer, the term of this patent is extended or adjusted under 35 U.S.C. 154(b) by 236 days.

(21) Appl. No.: 16/368,458

(22) Filed: Mar. 28, 2019

(65) Prior Publication Data

US 2020/0305677 A1 Oct. 1, 2020

(51) Int. Cl.
*A47L 15/00* (2006.01)

(52) U.S. Cl.
CPC ..... *A47L 15/0049* (2013.01); *A47L 15/0076* (2013.01)

(58) Field of Classification Search
None
See application file for complete search history.

(56) References Cited

U.S. PATENT DOCUMENTS 4,561,904 A * 12/1985 Eberhardt, Jr. ..... A47L 15/0047 134/18
5,267,580 A * 12/1993 Payzant ..... A47L 15/241 134/108
9,144,365 B1 * 9/2015 Constance ..... A47L 15/247
2002/0020435 A1 * 2/2002 Varpio ..... A47L 15/0021 134/18
2012/0037185 A1 * 2/2012 Ellingson ..... A47L 15/241 134/18

* cited by examiner

*Primary Examiner* — Cristi J Tate-Sims
(74) *Attorney, Agent, or Firm* — Lathrop GPM LLP

(57) ABSTRACT

A dish overflow protection system for a dishwasher. The dishwasher has a conveyor mechanism, a holding area, and a washing system. The dish overflow protection system has a housing including a user interface. A first sensor is disposed on the housing and is configured to take a first reading. A second sensor is remote from the housing and is configured to take a second reading. The dish overflow protection system has a control unit configured to halt operation of the conveyor mechanism where a difference between the first reading and the second reading is greater than a threshold. The user interface is usable to modify the threshold.

15 Claims, 4 Drawing Sheets

DISH OVERFLOW PROTECTION SYSTEMS FOR DISH MACHINES AND METHODS OF MAKING AND USING SAME

FIELD OF THE DISCLOSURE

The disclosure relates generally to dish overflow protection systems for dish machines, and to methods of making and using such dish overflow protection systems. More specifically, the disclosure relates to dish overflow protection systems which use a plurality of sensors to monitor and/or control a dishwashing device.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In an embodiment, a dish overflow protection system for a dishwasher is disclosed. The dishwasher has a conveyor mechanism, a holding area, and a washing system. The dish overflow protection system has a housing including a user interface. A first sensor is disposed on the housing and is configured to take a first reading. A second sensor is remote from the housing and is configured to take a second reading. The dish overflow protection system has a control unit configured to halt operation of the conveyor mechanism where a difference between the first reading and the second reading is greater than a threshold. The user interface is usable to modify the threshold.

In another embodiment, a dish overflow protection system for a dishwasher having a conveyor mechanism, a holding area, and a washing system is disclosed. The dish overflow protection system comprises a housing having a user interface. A first sensor is disposed on the housing and is configured to take a first reading. A second sensor is remote from the housing and is configured to take a second reading. A control unit is configured to halt operation of the conveyor mechanism in response to an evaluation of the first reading in view of the second reading.

In yet another embodiment, a dish overflow protection system for a dishwasher is shown. The dishwasher has a conveyor mechanism, a holding area, and a washing system. The dish overflow protection system includes a housing having a user interface. A first sensor is disposed on the housing and is configured to take a first reading. A second sensor is remote from the housing and is configured to take a second reading. A control unit is configured to halt operation of the conveyor mechanism when the difference between the first reading and the second reading exceeds a threshold.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Figure 1:
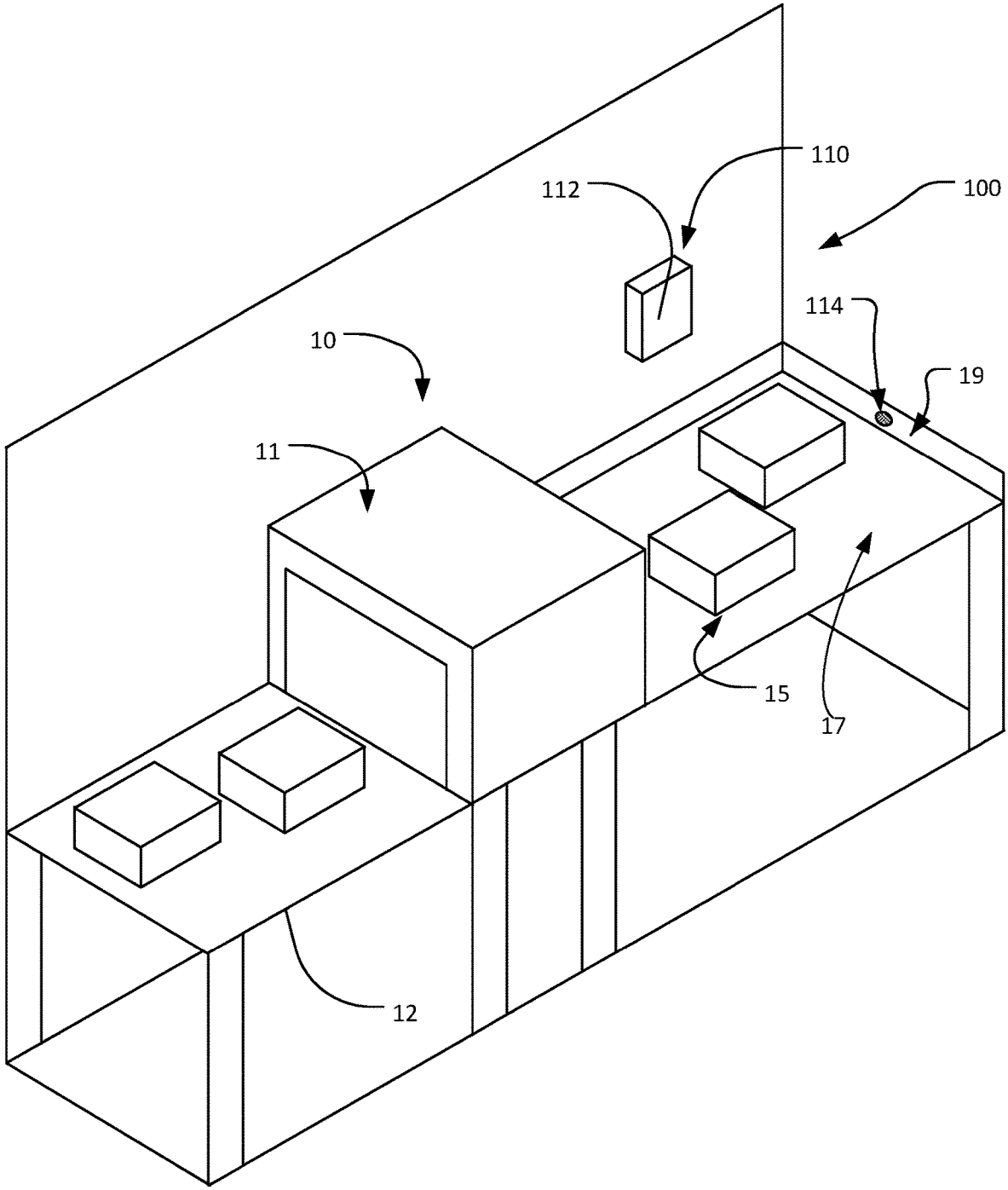
FIG. 1 is a perspective view of a dish machine having a dish overflow protection system, according to an embodiment of the present disclosure.
Figure 2:
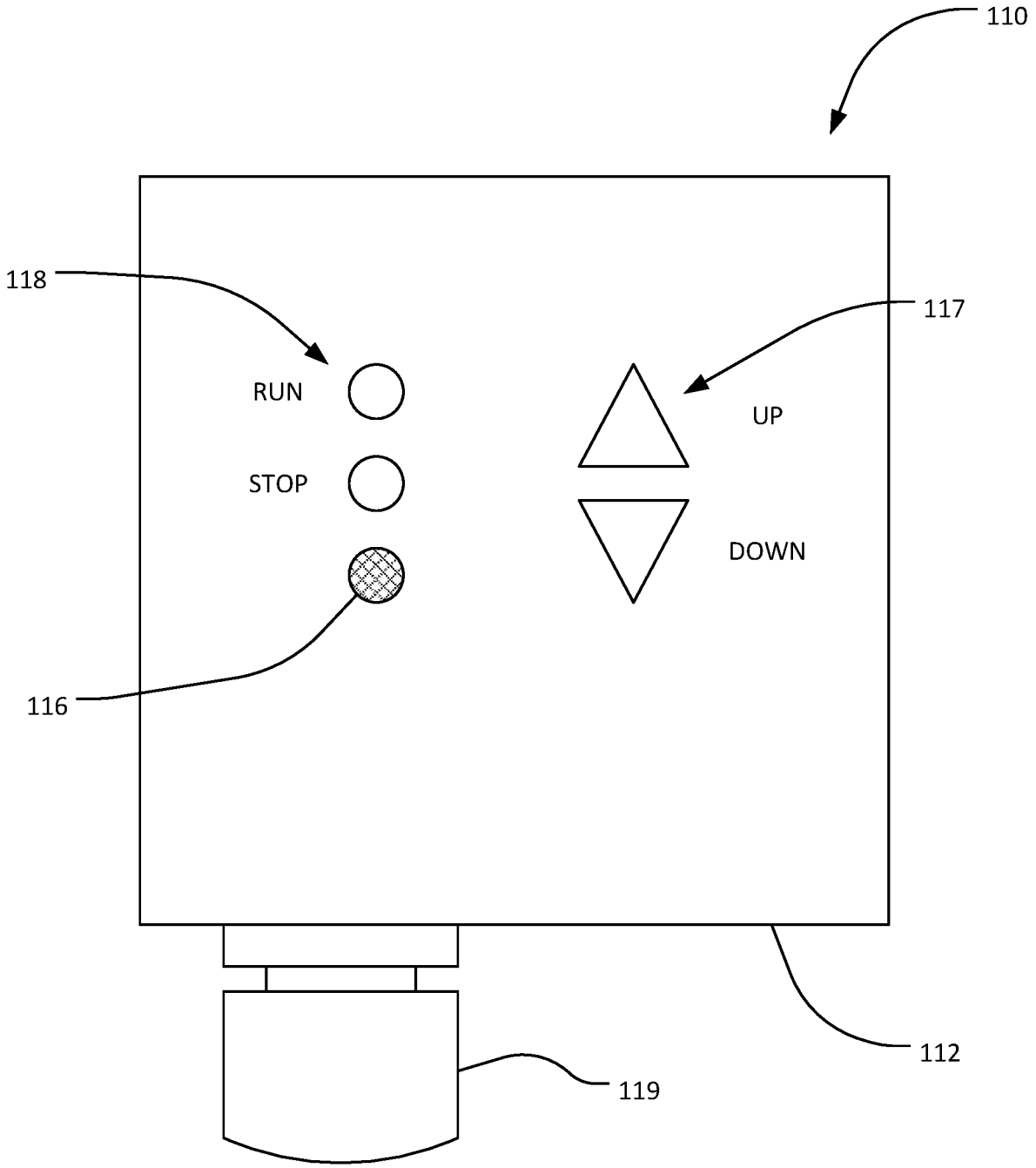
FIG. 2 is a top view of an example housing of a control unit of the dish overflow protection system of FIG. 1.
Figure 3:
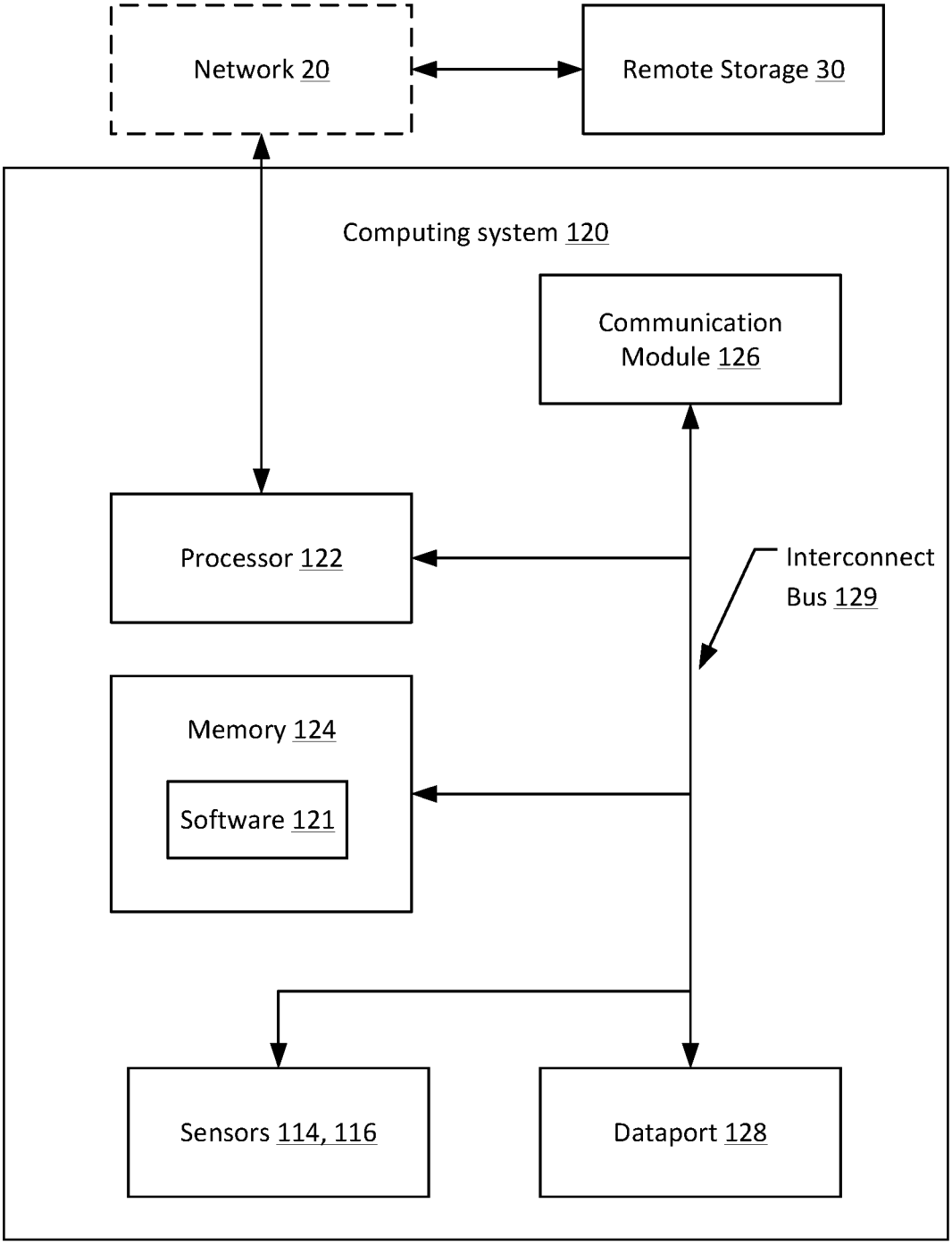
FIG. 3 is a functional block diagram depicting a computing system usable with the dish overflow protection system of FIG. 1.

FIGS. 1 through 3 show an embodiment 100 of a dish overflow protection system for use with a dish machine 10. In embodiments, the dish overflow protection system 100 may monitor and/or control the operation of the dish machine 10. The dish machine 10 may be an existing dish machine that is retrofitted with the dish overflow protection system 100. Alternately, the dish machine 10 may be manufactured with the dish overflow protection system 100 as an integral or attachable component thereof.

The dishwasher (or dish machine) 10 may include a washing system 11 and a conveyor mechanism 12 (e.g., stainless steel or other pusher dogs, a belt, etc.), only a portion of which is shown in FIG. 1. The conveyor mechanism 12 may be usable to transport dirty dishes to the washing system 11 for cleaning. More specifically, a user may place dirty dishes on the conveyor mechanism 12 in dish racks 15, and the conveyor mechanism 12 may cause the dish racks 15 to go through the washing system 11 for cleaning of the dirty dishes. The dish racks 15, upon being cleaned by the washing system 11, may be transported away from the washing system 15 to a holding area 17 (e.g., a table), where they may be picked up by an operator or another for use. The holding area 17 may be configured to collect the dish racks 15 containing cleaned dishes such that the chances of the dish racks 15 falling off the holding area 17 are minimized. For example, the holding area 17 may have a safety device 19, such as a lip, sidewalls, etc., intended to preclude racks 15 of clean dishes from falling off the holding area 17. Alternately or in addition, the holding area 17 may be L-shaped to minimize the chances of the racks 15 falling off the holding area 17.

In some cases, as the washing system 11 continues to clean the dirty dishes, the dish racks 15 may begin to accumulate towards the end of the holding area 17 (e.g., proximate the safety device 19). This may occur, for example, when an inattentive operator is slow to remove the racks 15 of clean dishes from the holding area 17. Eventually, the racks 15 may begin to pile up. Such may be undesirable, at least because the piled-up racks 15 may put undue stress on the washing system 11, the conveyor mechanism 12, and/or on the dishes in the racks 15 themselves. Over time, as additional racks 15 of clean dishes accumulate towards the end of the table 17, the table's safety device (e.g., the sidewall or lip 19) may be rendered unable to preclude the racks 15 from falling off the holding area 17. One or more racks 15 may consequently fall off the holding area 17 onto the ground or other surface. This may cause the dishes and/or the racks 15 to break, and consequently, cause undue damage. Further, the forces associated with the racks 15 repetitively striking against the lip 19 may damage the conveyer 12, e.g., the motor, the gear/chain drive, the pusher dogs, et cetera, thereof. Embodiments of the dish overflow protection system 100 disclosed herein may remedy these problems at least in part.

The dish overflow protection system 100 may include a computing system, an interface to control the computing system, and at least one sensor communicatively coupled to the computing system. In embodiments, the dish overflow protection system 100 may include two or more sensors, each of which may be communicatively coupled to the computing system via a wired and/or a wireless connection. In these embodiments, and as discussed herein, the two sensors may be disposed at different locations.

In more detail, the dish overflow protection system 100 may include a control unit 110. The control unit 110 may comprise a computing system 120 (FIG. 3), a rack sensor 114 (FIG. 1), an ambient light sensor 116 (FIG. 2), a user interface 117, and a communications device 119. One or more of these control unit components may be housed in a housing 112 in whole or in part. For example, in an embodiment, the housing 112 may house the computing system 120 and communications device 119 at least in part and the ambient light sensor 116 and the user interface 117 may be provided on the housing 112. The rack sensor 114, as discussed herein, may be situated elsewhere, and may communicate with the control unit 110 (e.g., with the computing system 120 thereof) via a wired and/or wireless connection.

The housing 112, which as noted may encapsulate one or more components of the control unit 110 in whole or in part, may be situated on, adjacent, or near the dishwasher 10, such as on a nearby wall. The housing 112 may be configured to protect one or more components of the control unit 110 from environmental conditions, e.g., moisture, heat, impact, et cetera. In embodiments, the housing 112 may be water proof or water resistant.

In operation, the control unit 110 may monitor the position of the racks 15 that have been cleaned by the washing system 11. Specifically, and as discussed in more detail below, the control unit 110 may generate a signal S in response to a determination that the racks 15 have reached a "position limit" (e.g., when one or more racks 15 is at the edge of the holding area 17, such as proximate or in contact with the safety device 19 thereof). The signal S may serve modify operation of the dishwasher 10, e.g., by causing the power to the conveyor mechanism 12 to be cut off to ensure that additional racks 15 are not pushed towards the edge of the holding area 17. Alternately or additionally, the signal S may direct components of the control unit 110 to alert a user of the fact that the holding area 17 is full. The alert may be one or more of a sound, flashing of a light, an electronic message, a text, et cetera.

The rack sensor 114 may be disposed somewhere on, adjacent, or near the dishwasher 10, and in embodiments, may be disposed remote from (e.g., 1 foot, 2 feet, 10 feet, etc. away from) the ambient light sensor 116 and the housing 112. The location of the rack sensor 114 may be chosen to allow the rack sensor 114 to monitor the position of the racks 15 that have passed through the washing system 11. The rack sensor 114 may, for example, be situated on the safety device 19 of (or elsewhere on) the holding area 17.

The rack sensor 114 may be any suitable sensor usable for detecting the position of a rack 15, such as an optical type sensor (e.g., a photovoltaic sensor, a phototransistor sensor, a photoconductive sensor, a photodiode sensor, an integrated optical circuit, a through-beam sensor, a retroreflective sensor, a diffuse reflection sensor), an audio sensor, a video sensor, et cetera. In some embodiments, a plurality of sensors is used as the rack sensors 114. Alternately or additionally, other types of sensors may be used, such as an ultrasonic sensor, an infrared sensor, a string potentiometer, et cetera. In operation, the rack sensor 114 may be usable to detect, estimate, or otherwise determine the position of the rack 15. For example, the rack sensor 114 may be usable to determine when the rack 15 reaches the position limit (such as by identifying when the rack 15 is at a predefined distance away from the rack sensor 114 or within a sensing range thereof). In some embodiments, the system 100 may use the rack sensor readings to determine that the racks 15 are at the position limit based on a determination that the holding area 17 or a portion thereof is full of dish racks 15 and no more racks 15 may safely fit thereon (e.g., by evaluating an amount of light sensed by the rack sensor 114, which may decrease as additional racks 15 are deposited in the holding area). The rack sensor reading may be communicated to the control unit 110 via a wired and/or a wireless connection and the control unit 110 may take an action or cause an action to be taken in response to an evaluation thereof.

The action taken by the control unit 110 in response to the reading of the sensors 114, 116 may include generating the signal S, which may in-turn modify the operation of the dish machine 10. For instance, the control unit 110 may be electrically coupled to conveyor 12 (e.g., to the conveyor motor contactor coil thereof) and may halt the conveyor 12 in response to the reading of the sensors 114, 116, as discussed herein. Alternately, the signal S may serve to alert a user (e.g., via a light, an emitted sound, an electronic message alert, text, et cetera) that one or more racks 15 are at the position limit and that the operator needs to take an action (e.g., manually turn the dish machine 10 off, remove one or more racks 15 from the holding area 17, et cetera). In embodiments, the control unit 110 may modify operation of the dish machine 10 and simultaneously or generally simultaneously alert the operator about the fact that one or more racks 15 have reached the position limit.

In the prior art, the dish overflow protection system may utilize only one sensor. For example, the prior art dish overflow protection system may utilize only the rack sensor, and the prior art dish overflow protection system may modify operation of the dish machine 10 based on a reading of this solitary rack sensor. For instance, if the light level sensed by the solitary sensor in two successive measurements exhibits a decrease, the prior art dish overflow protection system may determine that the decrease is attributable to a rack 15 that has come proximate the sensor/safety device 19, and in response, take an action (e.g., generate an alarm). However, two successive measurements may be disparate for reasons unrelated to rack position. For instance, the disparity between two successive readings may be caused by a light in the room being switched off, blinds in the room being closed, et cetera. The prior art dish overflow protection systems have no mechanism to account for such changes in environmental conditions and may therefore take an action even when the position limit is not reached, resulting in false alarms. These false alarms may be disruptive. Experience has shown that the operator may disable the prior art dishwasher overflow protection systems altogether because of the frequent false alarms associated therewith. This may be undesirable at least because the dishes in the dish racks 15 may break by falling off the holding area 17 notwithstanding the presence of an overflow protection system. The two sensors (i.e., sensors 114 and 116) of the dish overflow protection system 100 may alleviate this problem. Specifically, the dish overflow protection system 100 may take the readings of both the ambient light sensor 116 and the rack sensor 114 into account in determining that one or more racks 15 have reached the position limit.

The ambient light sensor 116 may be disposed on and/or within the housing 112. Alternately, the ambient light sensor 116 may be situated elsewhere (preferably remote from the rack sensor 114) and may be configured to communicate with the control unit 110 over a wireless or wired connection. The ambient light sensor 116, akin to the rack sensor 114, may be any suitable sensor for detecting the amount of light in an area, such as an optical type sensor (e.g., a photovoltaic sensor, a phototransistor sensor, a photoconductive sensor, a photodiode sensor, an integrated optical circuit, et cetera). In some embodiments, a plurality of sensors is used as the ambient light sensor 116. Alternately or additionally, other types of suitable sensors may be used as the ambient light sensor 116. In operation, the ambient light sensor 116 may be positioned to detect an amount of ambient light in a given space, such as an area proximate the dish machine 100.

In an embodiment, the dish safety device 100 may generate the signal S (i.e., determine that a position limit has been reached) by evaluating the reading of one sensor (e.g., the rack sensor 114) in view of the other sensor (e.g., the ambient light sensor 116). For instance, the control unit 110 may determine that the position limit has been reached when the difference between the measurements of the rack sensor 114 and the ambient light sensor 116 exceeds a threshold (here, a "threshold difference" TL). If, for example, the light in a room is switched off, it may affect the readings of each of the rack sensor 114 and the ambient light sensor 116 in generally the same way such that any difference between their readings remains below the threshold difference TL. By generating the signal S in response to the readings of two sensors remote from each other, as opposed to the reading of a solitary sensor, the system 100 may reduce false positives and increase the likelihood that the signal S is only generated when one or more racks 15 have reached the position limit.

The threshold difference TL may depend on the application, the type of sensors being used, the lighting in the room, et cetera, and may easily be determined for a given system 100. In general, the reaching of the position limit by one or more racks 15 may disproportionately reduce the light reading of the rack sensor 114 as compared to the ambient light sensor 116. This is because the rack 15 at the position limit may substantially block the light that otherwise would been received by the rack sensor 114 but may have minimal or no impact to the light being received by the ambient light sensor 116.

As discussed, in some embodiments, the system 100 may determine that the position limit has been reached based on an evaluation of the difference between the readings of the ambient light sensor 116 and the rack sensor 114. Alternately or in addition, the system 100 may use one sensor (e.g., the ambient light sensor 116) to dynamically or otherwise modify the sensitivity of the other sensor (e.g., the rack sensor 114). For instance, the threshold difference may be increased or decreased depending on the light levels being received by the two sensors 114 and 116. This may allow the rack sensor 114 to adjust to environmental conditions, such as low light conditions within a given space. Such added flexibility may further increase the accuracy with which the position limit conditions are identified.

In embodiments, a user may be able to manually modify the threshold difference TL to account for environmental conditions (e.g., lighting) in the room and the location of the rack sensor 114 and the ambient light sensor 116 therein. For example, in embodiments, the housing 112 may include the user interface 117. The user interface 117 may be disposed on and/or within the housing 112, and may be any combination of suitable buttons, toggles, switches, knobs, text, instructions, touch screens, displays, and the like. The interface 117 may be usable by a user to modify operation of the dishwasher overflow protection system 100. In an embodiment, the user interface 117 may include an up-arrow button and a down-arrow button for adjusting a sensing characteristic (e.g., a sensitivity, a required threshold difference TL, etc.) of the rack sensor 114 and/or the ambient sensor 116. The up-arrow and down-arrow buttons and/or other buttons, where provided, may in embodiments be covered with a flip up cover to protect these buttons during periods of non-use. In an embodiment, where the system 100 does not generate the signal S soon enough (e.g., does not halt the conveyor 12 upon the rack 15 coming within a few inches of the rack sensor 114), the down button may be pressed to bias the operation of the system 100 towards a halt condition. Similarly, where the system generates the signal S too soon (e.g., halts the conveyor 12 prematurely or intermittently), the up button may be pressed to bias the operation of the system 100 towards a run condition. The user interface 117 may thus allow a user to adjust the difference threshold TL if needed.

In some embodiments, the user interface 117 may include indicators 118 (e.g., audio speakers, lights, LEDs, etc.) configured to alert a user to functions of the dishwasher protection system 100. For instance, indicators 118 may generate a sound and/or a light to alert a user to: a user interface 117 button push, a rack 15 detection by the rack sensor 114, a change in operation mode of the dishwasher 10 (e.g., the conveyor 12 of the dishwasher 10 has been halted), et cetera. In embodiments, the user may select the alert type using the interface 117 or otherwise (e.g., via a computer application for controlling the system 100).

The communications device 119 may be used to communicatively couple (e.g., wired and/or wirelessly) two or more components of the control unit 110, such as the rack sensor 114, the ambient sensor 116, the user interface 117, et cetera. In some embodiments, the communications device 119 may be used to communicatively couple the control unit 110 with external devices, such as the dish machine 10. The communication device 119 may include one or more transceiver modules configured for transmitting and receiving data, and using, for example, one or more protocols and/or technologies, such as Bluetooth, GSM, UMTS (3GSM), IS-95 (CDMA one), IS-2000 (CDMA 2000), LTE, FDMA, TDMA, W-CDMA, CDMA, OFDMA, Wi-Fi, WiMAX, or any other protocol and/or technology. Alternately or additionally, the communications device 119 may include any type of connector used for physically interfacing with other devices, such as a USB port, a mini-USB port, or a 3.5 mm jack port. In operation, the communications device 119 may route incoming/outgoing data throughout the control unit 110. For example, the rack sensor 114 and the ambient sensor 116 may route their sensor information through the communications device 119. Alternately or additionally, the communications device 119 may route commands or instructions to other devices. For example, the communications device 119 may route instructions to the dishwasher 10 to modify its operation (e.g., a command to turn off the conveyor 12).

FIG. 3 is a functional block diagram of a computing system 120 which may be used to implement the various embodiments of the dish overflow protection system 100. The computing system 120 may comprise, for example, a printed circuit board or other computing device whether now known or subsequently developed. In some embodiments, at least some of the components of the computing system 120 are disposed within the housing 112. Alternately or additionally, at least some of the components of the computing system 120 are disposed separate and/or remote from the housing 112.

The computing system 120 may include a processor 122, a memory 124, a communication module 126, and a dataport 128. These components may be communicatively coupled (e.g., wired and/or wirelessly) together by an interconnect bus 129. A user may interact with the computing system 120 via a user interface, such as the user interface 117, a graphical user interface, a display, a computer monitor, a keyboard and mouse, a touch screen, et cetera. The processor 122 may include any processor used in smartphones and/or other computing devices, including an analog processor (e.g., a Nano carbon-based processor) or microcontroller. In certain embodiments, the processor 122 may include one or more other processors, such as one or more microprocessors, and/or one or more supplementary co-processors, such as math co-processors.

The memory 124 may include both operating memory, such as random access memory (RAM), as well as data storage, such as read-only memory (ROM), hard drives, optical, flash memory, or any other suitable memory/storage element. The memory 124 may include removable memory elements, such as a CompactFlash card, a MultiMediaCard (MMC), and/or a Secure Digital (SD) card. In certain embodiments, the memory 124 may include a combination of magnetic, optical, and/or semiconductor memory, and may include, for example, RAM, ROM, flash drive, and/or a hard disk or drive. The processor 122 and the memory 124 each may be located entirely within a single device, or may be connected to each other by a communication medium, such as a USB port, a serial port cable, a coaxial cable, an Ethernet-type cable, a telephone line, a radio frequency transceiver, or other similar wireless or wired medium or combination of the foregoing. For example, the processor 122 may be connected to the memory 124 via the dataport 128.

The communication module 126 may be configured to handle communication links between the computing system 120 and other internal/external devices or receivers, and to route incoming/outgoing data appropriately. For example, inbound data from the dataport 128 may be routed through the communication module 126 before being directed to the processor 122, outbound data from the processor 122 may be routed through the communication module 126 before being directed to the dataport 128, and communication between the rack sensor 114 and the ambient sensor 116 may be routed through the communication module 126. The communication module 126 may include one or more transceiver modules configured for transmitting and receiving data, and using, for example, one or more protocols and/or technologies, such as Bluetooth, GSM, UMTS (3GSM), IS-95 (CDMA one), IS-2000 (CDMA 2000), LTE, FDMA, TDMA, W-CDMA, CDMA, OFDMA, Wi-Fi, WiMAX, or any other protocol and/or technology.

In some embodiments, operation of the computing system 120 may be modified via the communications module 126. For example, an external device, such as another computing system, may communicate with the computing system 120 via the communications module 126, and may send commands for directing the operation of the computing system 120. In some embodiments, the rack sensor 114 and/or the ambient sensor 116 may be communicatively linked, wired and/or wirelessly, to the computing system 120 via the communications module 126, for communication therebetween (e.g., for the transference of detected light information). The computing system 120 may respond to the detected light information by, for example, generating the signal S.

The dataport 128 may be any type of connector used for physically interfacing with a smartphone, computer, and/or other devices, such as a USB port, a mini-USB port, or a 3.5 mm jack port. In other embodiments, the dataport 128 may include multiple communication channels for simultaneous communication with, for example, other processors, servers, and/or client terminals. Alternately or additionally, the dataport 128 may be configured to communicatively link (e.g., wirelessly through the network 20) to components, such as the rack sensor 114 and ambient sensor 116.

The memory 124 may store instructions for communicating with other systems, such as a computer. The memory 124 may store, for example, a program (e.g., computer program code) adapted to direct the processor 122 in accordance with the present embodiments. The instructions also may include program elements, such as an operating system. While execution of sequences of instructions in the program causes the processor 122 to perform the process steps described herein, hard-wired circuitry may be used in place of, or in combination with, software/firmware instructions for implementation of the processes of the present disclosure. Thus, unless expressly noted, the disclosure is not limited to any specific combination of hardware and software.

In some embodiments, the memory 124 may include software 121 (i.e., machine readable instructions) configured to be executed by the processor 122. The software 121 may, for example, process data obtained from the sensors 114 and 116 (e.g., determine a difference therebetween, ascertain whether the position limit has been reached and if so, cause the signal S to be generated). In some embodiments, the software 121 may cause the computing system 120 to dynamically respond to a reading obtained by the rack sensor 114 and/or the ambient light sensor 116.

In some embodiments, the software 121 may use an algorithm to allow for better detection of a rack 15 using the rack sensor 114 and the ambient light sensor 116. For example, the software 121 may use the light level detected by the ambient light sensor 116 to determine the light level of the rack sensor 114 at which the signal S would be generated. In some embodiments, the software 121 may have machine readable instructions configured to enact some or all of the operations of the user interface 117. For example, the software 121 may include instructions for a graphical user interface and/or an analog interface that allows a user to modify the operation of the dishwasher protection system 100 (e.g., the sensors 114 and 116, the computing system 120, etc.), as described above.

The computing system 120 may be in data communication with a remote storage 30 over the network 20. The network 20 may be a wired network, a wireless network, or comprise elements of both. The remote storage 30 may be, for example, the "cloud" or other remote storage in communication with other computer systems. In some embodiments, data (e.g., readings obtained by the sensors 114 and 116 and the dynamic responses of the computing system 120 thereto) may be stored in the remote storage 30 for analytics or other applications. In some embodiments, the remote storage 30 and/or the memory 124 may, among other things, store historical data of the system 100 (e.g., data for the last year, last five years, et cetera). The system 100, in such embodiments, may take such historical data into account when setting the threshold difference TL (e.g., the threshold difference TL may be recalculated on a day where historical data on that day last year suggests the calculated threshold difference is inaccurate). In embodiments, the threshold difference TL may be varied based on time of day (e.g., measurements taken in the morning, in the afternoon, in the evening, at night, etc., may be used to determine an initial appropriate threshold difference TL during these times on another day and/or on that day).

In embodiments, the system 100 may have an emergency disable feature. For example, in embodiments, both the up-button and the down-button may be depressed together to power off the system 100 (without impacting the functionality of the dish machine 10). The system 100 may be powered using conventional 110V or 220V. In some embodiments, the system may be battery operated.

Figure 4:
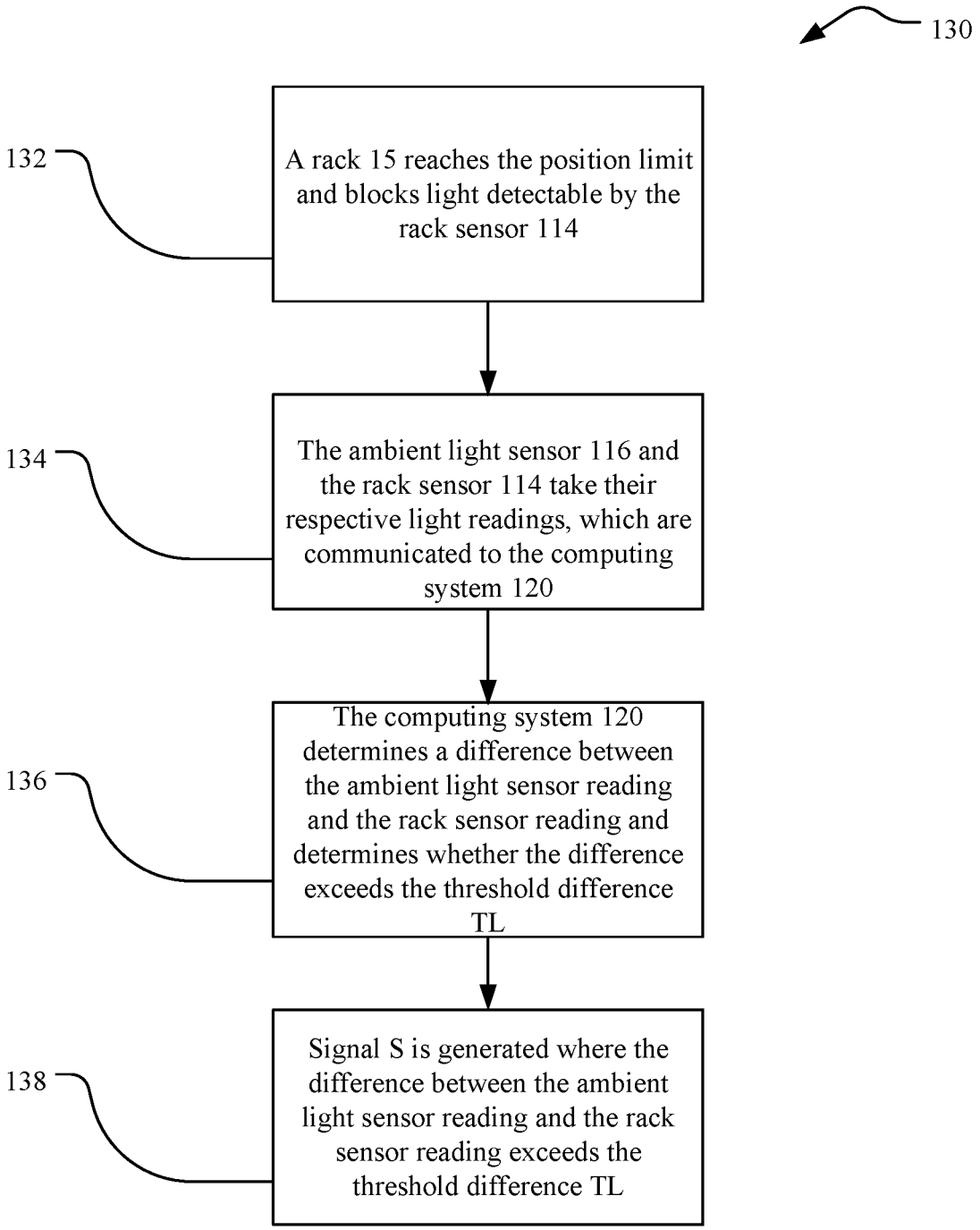
FIG. 4 is a flowchart illustrating an example method of using the dish machine with the dish overflow protection system of FIG. 1.

FIG. 4 illustrates an example method 130 of operating the dishwasher protection system 100, in an embodiment.

At step 132, a rack 15 may reach the position limit (e.g., may come proximate the holding area 17 and/or the safety device 19 thereof) and block light detectable by the rack sensor 114.

Next, at step 134, the ambient light sensor 116 and the rack sensor 114 may take their respective light readings, each of which may be communicated to the computing system 120. The readings may be taken generally simultaneously, or alternatively, may be taken successively.

At step 136, the computing system 120 may evaluate and compare the two readings. For example, at step 136, the computing system 120 together with the software 121 thereof may determine a difference between the ambient light sensor reading and the rack sensor reading and determine whether the difference exceeds the threshold difference TL. In this example, because of the position of the one or more racks at the position limit at step 132, the computing system 136 may determine that the difference between the ambient light sensor reading and the rack sensor reading is greater than the threshold difference TL. Had that not been the case, the system 100 would continue to evaluate successive readings of the ambient light sensor 116 and the rack sensor 114.

At step 138, the signal S may be generated where the difference between the ambient light sensor reading and the rack sensor reading exceeds the threshold. As discussed above, the signal S may be an audible signal, visual signal, or other alert. Alternately or additionally, the signal S may correspond to a change in machine operation (e.g., the halting of the conveyor mechanism 12).

The artisan will understand the steps of the method 130 may be modified or omitted as desired, and additional steps not expressly discussed herein may be added. For example, a user may interact with the user interface 117 to adjust a sensing characteristic of the sensor 114 and/or 116. As another example, the ambient sensor 116 may continuously gather ambient light level information to allow for continual adjustment of the operation of the rack sensor 114. As another example, in some embodiments, the rack sensor 114 may detect the proximity of a rack 15 without its operation being modified in response to detected ambient light level information from the ambient sensor 116.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the disclosure. Not all steps listed in the various figures need be carried out in the specific order described.

The invention claimed is:

1. A dish overflow protection system for a dishwasher, said dishwasher having a conveyor mechanism, a holding area, and a washing system, said dish overflow protection system comprising:

a housing having a user interface;

a first sensor disposed on said housing and being configured to take a first reading;

a second sensor remote from said housing and being configured to take a second reading; and a control unit configured to halt operation of said conveyor mechanism in response to an evaluation of said first reading in view of said second reading, wherein the evaluation determines whether a difference between said first reading and said second reading exceeds a threshold and the user interface is usable to alter said threshold.

2. The dish overflow protection system of claim 1, wherein said first sensor is a light sensor.

3. The dish overflow protection system of claim 2, wherein said second sensor is a light sensor.

4. The dish overflow protection system of claim 1, wherein said control unit is configured to generate an alert when said operation of said conveyor mechanism is halted.

5. A dish overflow protection system for a dishwasher, said dishwasher having a conveyor mechanism, a holding area, and a washing system, said dish overflow protection system comprising:

a housing having a user interface;

a first sensor disposed on said housing and being configured to take a first reading;

a second sensor remote from said housing and being configured to take a second reading; and a control unit configured to take an action in response to an evaluation of said first reading in view of said second reading, wherein the evaluation determines whether a difference between said first reading and said second reading exceeds a threshold and the user interface is usable to alter said threshold and to disable said dish overflow protection system.

6. The dish overflow protection system of claim 5, wherein said action is the generation of an alert.

7. The dish overflow protection system of claim 5, wherein said action includes halting said conveyor mechanism.

8. The dish overflow protection system of claim 5, wherein each of said first sensor and said second sensor is a light sensor.

9. The dish overflow protection system of claim 5 further comprising a non-transitory memory for storing a historical record of said dish overflow protection system.

10. The dish overflow protection system of claim 5, wherein said second sensor is disposed on a safety device of said holding area.

11. A dish overflow protection system for a dishwasher, said dishwasher having a conveyor mechanism, a holding area, and a washing system, said dish overflow protection system comprising:

a housing having a user interface;

a first sensor disposed on said housing and being configured to take a first reading;

a second sensor remote from said housing and being configured to take a second reading; and a control unit configured to halt operation of said conveyor mechanism when a difference between said first reading and said second reading is greater than a threshold;

wherein, said user interface is usable to modify said threshold.

12. The dish overflow protection system of claim 11, wherein said user interface has an up-button and a down-button.

13. The dish overflow protection system of claim 11, wherein each of said first sensor and said second sensor is a light sensor.

14. The dish overflow protection system of claim 11, wherein said second sensor communicates with said control unit over a wired connection.

15. The dish overflow protection system of claim 11, wherein said second sensor communicates with said control unit over a wireless connection.

* * * * *